US005697717A

United States Patent [19]

Kaneko et al.

[11] Patent Number: 5,697,717

[45] Date of Patent: Dec. 16, 1997

[54] METHOD AND APPARATUS FOR CONTROLLING SUPPLY OF ELECTRIC POWER TO AN INDICATOR FOR INDICATING A STATE OF THE APPARATUS

[75] Inventors: Yuichi Kaneko, Yokohama; Tetsuhito Ikeda; Akira Kuribayashi, both of Kawasaki; Junichi Arakawa, Yokohama; Hideo Horigome, Tokyo, all of Japan

[73] Assignee: Canon Kabushiki Kaisha, Tokyo, Japan

[21] Appl. No.: 535,318

[22] Filed: Sep. 27, 1995

Related U.S. Application Data

[63] Continuation of Ser. No. 169,398, Dec. 20, 1993, abandoned.

[30] Foreign Application Priority Data

Dec. 21, 1992 [JP] Japan ..... 4-340204
Dec. 14, 1993 [JP] Japan ..... 5-313584

[51] Int. Cl.[6] ..... B41J 29/00

[52] U.S. Cl. ..... 400/703; 400/711; 364/707

[58] Field of Search ..... 400/54, 88, 120 HH, 400/703, 711, 83; 364/707

[56] References Cited

U.S. PATENT DOCUMENTS

| | | | |
|---|---|---|---|
| 4,772,142 | 9/1988 | Makita | 400/711 |
| 4,825,250 | 4/1989 | Miyata et al. | 355/7 |
| 4,990,005 | 2/1991 | Karakawa | 400/703 |
| 5,089,690 | 2/1992 | Okamura | 400/703 |
| 5,182,583 | 1/1993 | Horigome et al. | 400/54 |
| 5,218,353 | 6/1993 | Okumura et al. | 400/711 |
| 5,381,161 | 1/1995 | Sasaki et al. | 364/707 |
| 5,383,140 | 1/1995 | Nanno et al. | 364/707 |
| 5,449,238 | 9/1995 | Pham et al. | 400/54 |
| 5,501,534 | 3/1996 | Mizoguchi | 400/54 |

FOREIGN PATENT DOCUMENTS

| | | | |
|---|---|---|---|
| 314569 | 11/1992 | Japan | 400/54 |

OTHER PUBLICATIONS

English translation of Japanese Laid-Open Patent Application No. 4-314569 (Nakamura), published Nov. 5, 1992.

*Primary Examiner*—Edgar S. Burr
*Assistant Examiner*—Steven S. Kelley
*Attorney, Agent, or Firm*—Fitzpatrick, Cella, Harper & Scinto

[57] ABSTRACT

A printer has an electric power supply controller which controls electric power supplied to an indicator indicating a state of the printer so as to prolong a driving time of the printer, which is driven by a battery. When the apparatus is set to an on-line state using an on-line key, electric power is initially supplied to an on-line LED, which indicates the apparatus is in the on-line state. Afterwards, when a predetermined time period has passed, the supply of electric power is cut off to the on-line LED, whereby the consumption of electric power supplied to the indicator can be minimized.

33 Claims, 5 Drawing Sheets

METHOD AND APPARATUS FOR CONTROLLING SUPPLY OF ELECTRIC POWER TO AN INDICATOR FOR INDICATING A STATE OF THE APPARATUS

This application is a continuation of application Ser. No. 08/169,398 filed Dec. 20, 1993, now abandoned.

BACKGROUND OF THE INVENTION

1. Field of the Invention

This invention relates to an apparatus such as a printer, and more specifically relates to an apparatus having an indicator such as a power light-emitting diode (LED) and an on-line LED indicating the operation mode, which is set by an operation key such as a power key and an on-line key, and relates to a method for supplying electric power to the indicator.

2. Related Background Art

A printer having an indicator such as an LED has hitherto been constructed such that the LED corresponding to and indicating each operation mode has been turned on continuously. For example, an on-line LED has been turned on continuously while the printer has been the in the on-line state, and a power LED has been turned on continuously while the electric power has been supplied to the printer.

A problem with this type of printer is that power consumption used by the indicator unrelated to the recording operation is large and cannot be disregarded because, as stated above, an LED corresponding to each operation mode is turned on continuously while the printer is in the corresponding operation mode.

Especially in a battery-powered printer, due to the power consumption of the indicator, the printer suffers from a problem in that a drivable time of the printer is significantly reduced.

SUMMARY OF THE INVENTION

This invention is designed to overcome the above problem in the background art and is based on a concept, which has not been recognized until now.

This invention aims to solve the above-mentioned problem in the background art. It is accordingly an object of this invention to minimize power consumption of an indicator indicating a condition of the apparatus, in order to maximize driving time of the apparatus driven by a battery.

Another object of this invention is to provide an apparatus including an indicator for indicating a predetermined state of the apparatus; an electric power supply device for supplying electric power to the indicator from a battery; a set-up device for setting up the apparatus in the predetermined state; and a controller for controlling the electric power supply device so that electric power is initially supplied to the indicator when the predetermined state of the apparatus is set up by the set-up device, and for controlling the electric power supply device so that the supply of electric power is stopped when a predetermined condition is met.

A further object of the present invention is to incorporate the apparatus described above in a printing apparatus including a printing device for printing information from a host device on a printing medium.

Still another object of this invention is to provide a method for supplying electric power to an indicator indicating a predetermined state of an apparatus, including the steps of providing the indicator, which is electrically driven by a battery; beginning supply of electric power from the battery to the indicator when the predetermined state of the apparatus is set up; and stopping supply of the electric power to the indicator when a predetermined condition is met.

DETAILED DESCRIPTION OF THE PREFERRED EMBODIMENTS

Preferred embodiments of this invention will now be described in detail with reference to the accompanying drawings.

Figure 1:
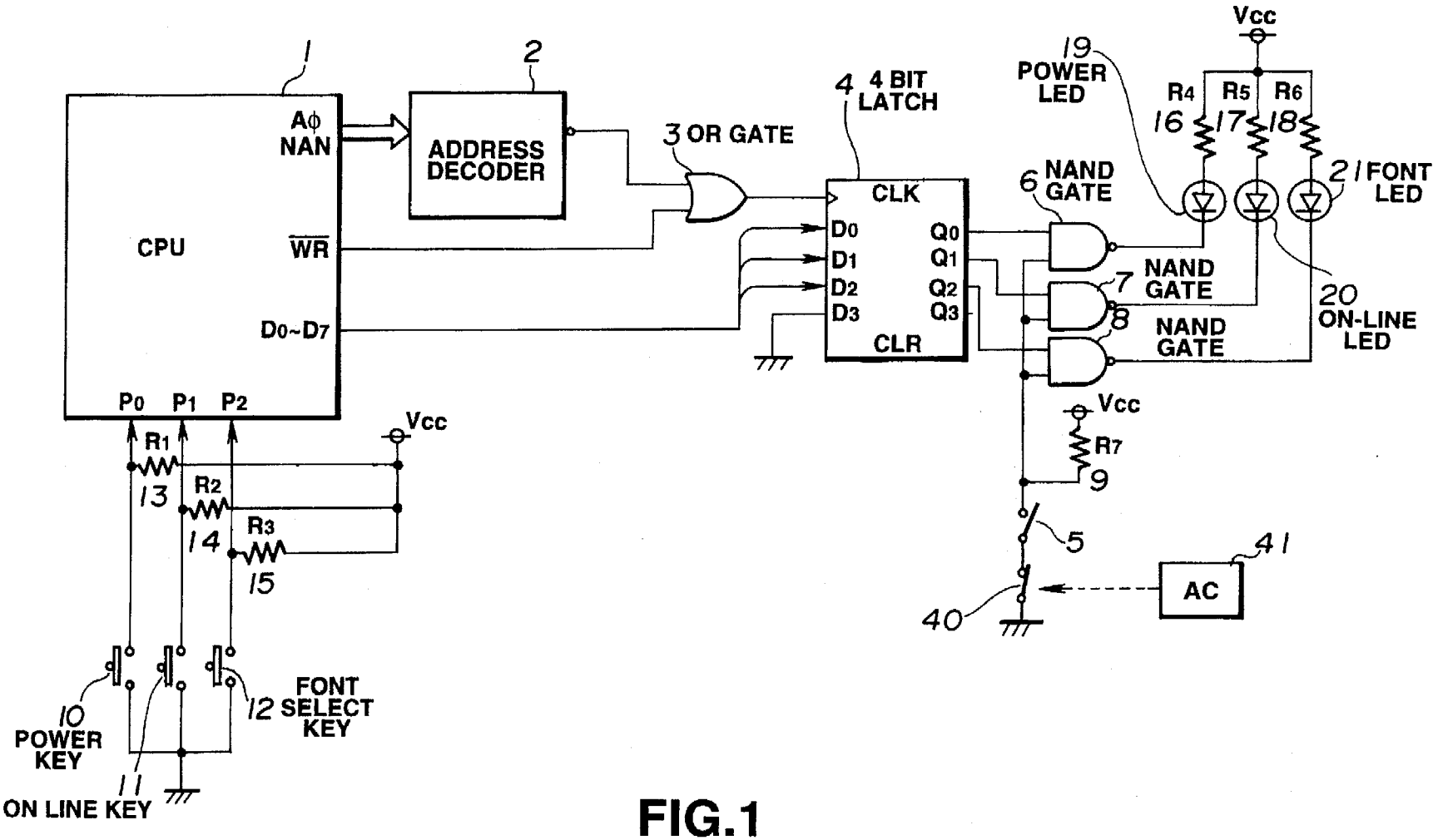
FIG. 1 is a block diagram showing the construction of a printer of a first embodiment of the present invention.

In the printer shown in FIG. 1, reference numeral 1 indicates a CPU, which controls the printer, reference numeral 2 indicates an address decoder ("00FFH" corresponds to an output level "L"), reference numeral 3 indicates an OR gate, reference numeral 4 indicates a 4-bit data latch, reference numeral 5 indicates an LED switch or LED override switch which turns on and off an LED indicator, reference numerals 6, 7 and 8 indicate open-collector output NAND gates, reference numerals 9, 13, 14 and 15 collectively indicate a pull-up resistance, reference numeral 10 indicates a power key, reference numeral 11 indicates an on-line key, reference numeral 12 indicates a font select key, and reference numerals 16, 17 and 18 collectively indicate a current restriction resistance.

Next, the operation of the printer according to the first embodiment will be described with reference to FIG. 1.

In the construction shown in FIG. 1, after the user turns on power switch 10 of the printer under the condition that LED switch 5 is turned off, an on-line switch is turned on. The power-on state and the on-line state of the apparatus are confirmed by the lighting of power LED 19 and on-line LED 20. Then, the lighting of the LEDs are turned off. The above operation will be explained in detail.

When the user turns on the power key 10, which operates as a set-up means to set up the printer to a predetermined state, the CPU 1 starts to perform a power-on operation and outputs address "00FFH" to the address decoder 2 and outputs data "xxxxx001" from outlet ports $D_0$~$D_7$ to the 4 bit latch 4. At that time, CPU 1 outputs a clock signal from outlet port WR to the OR gate 3, and the clock signal from the outlet port WR is supplied to the 4 bit latch 4 through the OR gate 3, because output of the address decoder 2 becomes "L". The data output from the output ports $D_0$~$D_7$ is latched by the 4 bit latch 4 in accordance with the clock signal sent through the OR gate 3, whereby the latch 4 sets the output $Q_0$ to be "H" so as to turn on the LED 19. As a result, the power LED 19 is turned on.

Next, when the user turns on the on-line key 11, the CPU 1 starts to perform an on-line operation and outputs address "00FFH" to the address decoder 2 and outputs data "xxxxx011" from outlet ports $D_0$~$D_7$ to the 4 bit latch 4. At that time, CPU 1 outputs a clock signal from outlet port WR to the OR gate 3, and the clock signal from the outlet port WR is supplied to the 4 bit latch 4 through the OR gate 3, because output of the address decoder 2 is "L". The data output from the output ports $D_0$~$D_7$ is latched by the 4 bit latch 4 in accordance with the clock signal sent through the OR gate 3, whereby the latch 4 sets the output $Q_0$ and $Q_1$ to be "H" so as to turn on the LEDs 19 and 20. As a result, both the power LED 19 and the on-line LED 20 are turned on.

Next, when the user turns on the LED switch 5, a respective output level of open collector NAND gates 6, 7 and 8 becomes of high impedance. As a result, the power LED 19 and the on-line LED 20 are turned off. Similar operations can be carried out with a font LED 21, or other indicator LEDs.

Thus, in accordance with this embodiment, an indicator can be selectively turned ON/OFF by the user, thereby reducing the electric power consumption of the printer in a case that the printer prints continuously in a same operation mode.

Moreover, in the first embodiment, as shown in FIG. 1, reference numeral 40 indicates a switch that is turned on when an alternating current (AC) power supply 41 is not connected to the printer, and is turned off when the AC power supply 41 is connected to the printer. In the above description, the printer is described using a battery as a power supply; however, when the AC power supply 41 is connected to the printer, it is not necessary to reduce the electric power consumption by cutting off the supply of electric power to the LEDs 19–21, and it would rather be preferable to keep the LEDs turned on in order to easily confirm the present operation mode visually. Accordingly, in the first embodiment, the switch 40 is provided and will be turned off when the AC power supply 41 is connected to the printer.

As the switch 40, a well-known switch capable of detecting the connection of the AC power supply to the printer mechanically or electrically can be used. When the switch 40 is turned off due to the connection of the AC power supply 41 to the printer, regardless of the turning-on of the LED switch 5, the respective output level of the open collector NAND gates 6, 7 and 8 becomes of low-impedance state, thereby keeping the power LED 19 and the on-line LED 20 turned on while the power key 10 and the on-line key 11 are turned on. Similar operations can be carried out with the font LED.

Next, the second embodiment of this invention will be described in detail with reference to FIG. 2.

Figure 2:
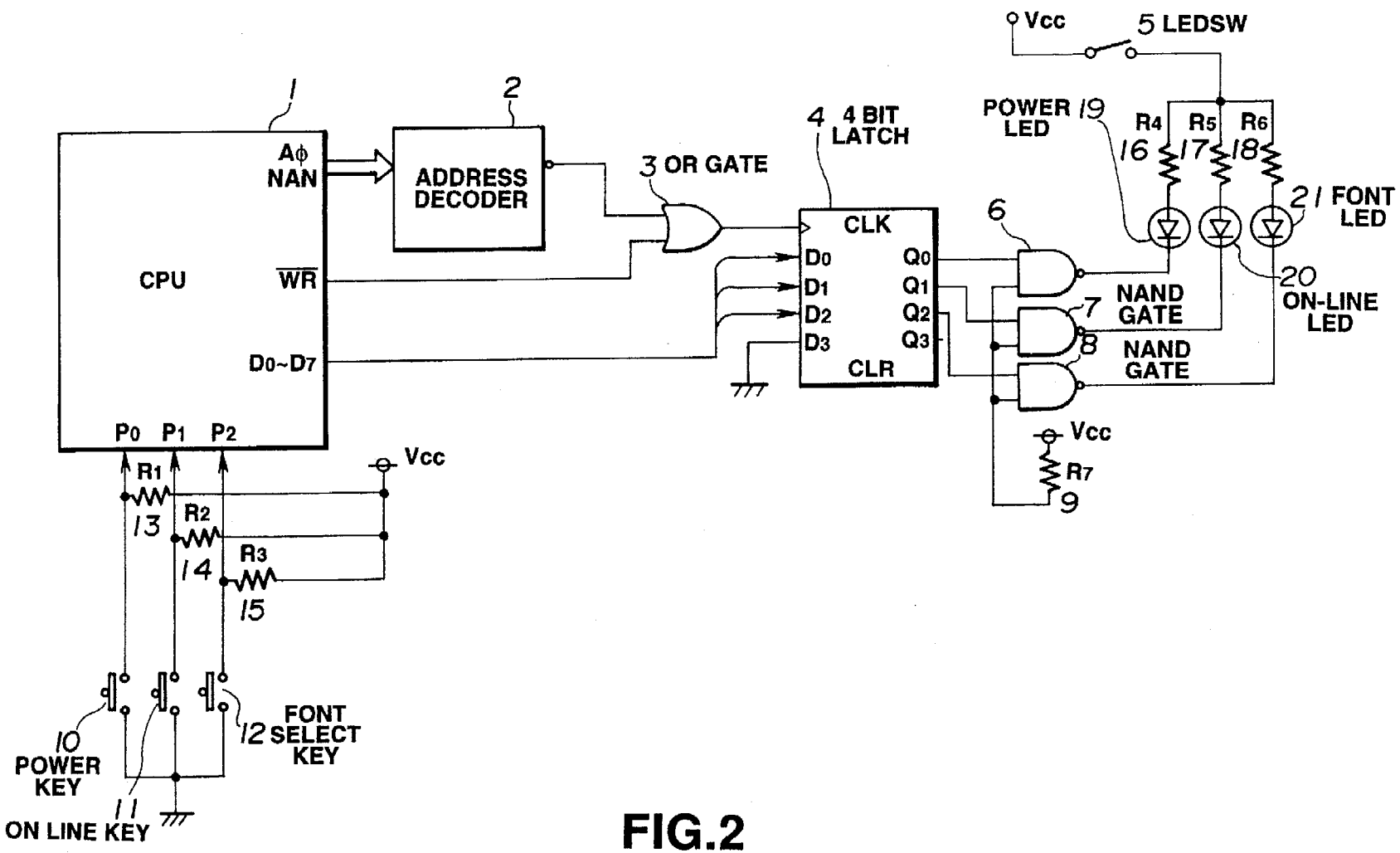
FIG. 2 is a block diagram showing the construction of a printer of a second embodiment of the present invention.

FIG. 2 is a block diagram showing a circuit of the apparatus designed in accordance with the second embodiment of this invention as applied to a printer.

In the drawing, those components common to FIG. 1 are referred to by the same reference numerals.

In FIG. 2, reference numeral 1 indicates a CPU which controls the printer, reference numeral 2 indicates an address decoder ("00FFH" corresponds to an output level "L"), reference numeral 3 indicates an OR gate, reference numeral 4 indicates a 4 bit data latch, reference numeral 5 indicates an LED switch or LED override switch which turns on and off an LED indicator, reference numerals 6, 7 and 8 indicate open-collector output NAND gates, reference numerals 9, 13, 14 and 15 collectively indicate a pull-up resistance, reference numeral 10 indicates a power key, reference numeral 11 indicates an on-line key, reference numeral 12 indicates a font select key, reference numerals 16, 17 and 18 collectively indicate a current restriction resistance of LED.

An operation of the printer according to the second embodiment will be described hereinafter with reference to FIG. 2.

In the construction shown in FIG. 2, after the user turns on the power switch of the printer under the condition that the LED switch 5 is turned ON, an on-line switch is turned on and the power-on state and the on-line state of the apparatus are confirmed by the lighting of the power LED 19 and the on-line LED 20. Afterwards, these LEDs are turned off.

The above operation will be explained in detail.

When the user turns on the power key 10, which operates as a set-up means to set up the printer to a predetermined state, the CPU 1 starts to perform a power-on operation and outputs address "00FFH" to the address decoder 2 and outputs data "xxxxx001", from outlet ports $D_0$~$D_7$ to the 4 bit latch 4. At that time, CPU 1 outputs a clock signal from outlet port WR to the OR gate 3, and the clock signal from the outlet port WR is supplied to the 4 bit latch 4 through the OR gate 3, because output of the address decoder 2 becomes "L". The data output from the output ports $D_0$~$D_7$ is latched by the 4 bit latch 4 in accordance with the clock signal sent through the OR gate 3, whereby the latch 4 sets the output $Q_0$ to be "H" so as to turn on the LED 19. As a result, the power LED 19 is turned on.

Next, when the user turns on the on-line key 11, the CPU 1 starts to perform an on-line operation and outputs address "00FFH" to the address decoder 2 and outputs data "xxxxx011" from outlet ports $D_0$~$D_7$ to the 4 bit latch 4. At that time, CPU 1 outputs a clock signal from outlet port WR to the OR gate 3, whereby the clock signal from the outlet port WR is supplied to the 4 bit latch 4 through the OR gate 3, because output of the address decoder 2 is "L". The data output from the output ports $D_0$~$D_7$ is latched by the 4 bit latch 4 in accordance with the clock signal sent through the OR gate 3, whereby the latch 4 sets the output $Q_0$ and $Q_1$ to be "H" so as to turn on the LEDs 19 and 20. As a result, the power LED 19 and the on-line LED 20 are turned on.

Next, when the user turns off the LED switch 5, as electric power from a battery power supply Vcc to the LED 19 and the LED 20 is cut off, the power LED 19 and the on-line LED 20 are turned off. Similar operations are carried out with the font LED 21.

Thus, in accordance with the second embodiment, the indicators can be selectively turned ON/OFF by the user, thereby reducing the electric power consumed by the indicators and conserving electric power consumed by the printer when printing continuously in a same operation mode.

The third embodiment of this invention will now be described in detail with reference to FIG. 3.

Figure 3:
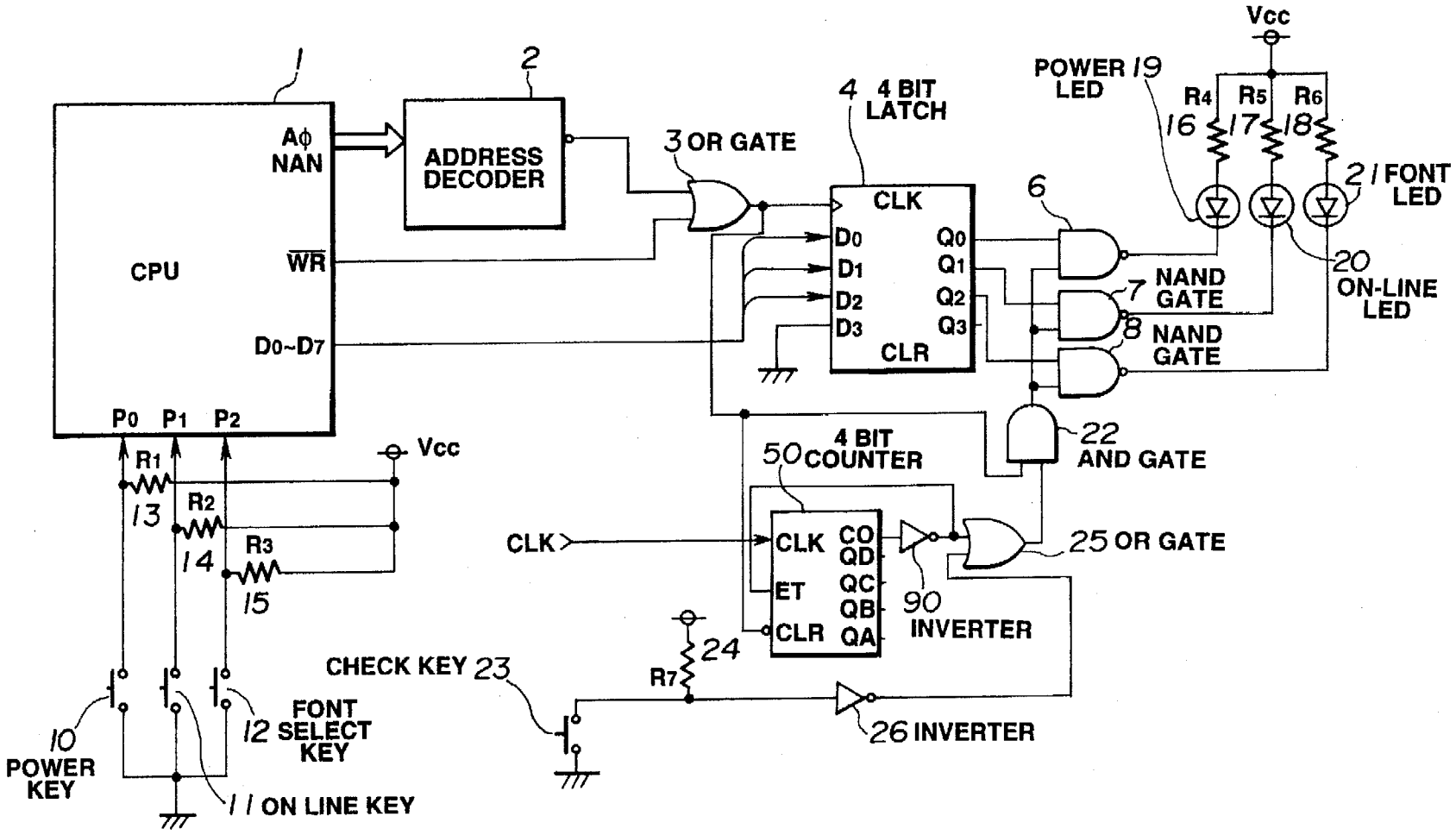
FIG. 3 is a block diagram showing the construction of a printer of a third embodiment of the present invention.

FIG. 3 is a block diagram showing a circuit of the apparatus designed in accordance with the third embodiment of this invention as applied to a printer.

In the drawing, those components common to FIG. 1 are referred to by the same reference numerals.

In FIG. 3, reference numeral 1 indicates a CPU which controls the printer, reference numeral 2 indicates an address decoder ("00FFH" corresponds to an output level "L"), reference numerals 3 and 25 indicate OR gates, reference numeral 4 indicates a 4 bit data latch, reference numeral 50 indicates a 4 bit counter, reference numerals 6, 7 and 8 indicate open-collector NAND gates, reference numerals 90 and 26 indicate inverters, reference numeral 10 indicates a power key, reference number 11 indicates an on-line key, reference numeral 12 indicates a font select key, reference numerals 13, 14, 15 and 28 collectively indicate a pull-up resistance, reference numerals 16, 17 and 18 collectively indicate a current restriction resistance for LED, reference numeral 19 indicates a power LED and is turned on when the electric power is supplied to the printer, reference numeral 20 indicates an on-line LED and is turned on when the printer is in an on-line state, reference numeral 21 indicates a font LED and is turned off when an A font is selected and is turned on when a B font is selected, reference numeral 22 indicates an AND gate, and reference numeral 23 indicates a check key.

An operation of the printer according to the third embodiment will be described hereinafter with reference to FIG. 3.

A power-on operation carried out when the printer is in a power-off state, an on-line state and font A selected state (all LEDs are turned off) will be described.

When the user turns on the power key 10 while in the power-off state, a level of a port input Po is changed from H to L. The CPU 1 detects this change and carries out the power-on operation of the printer, and writes the data "xxxxx001" in an address "00FFH" Then, a level of the output Qo of the 4 bit latch 4 is changed from "L" to "H", and the 4 bit counter 50 is cleared. Then, Co level is changed from "H" to "L", and an output level of the open collector NAND gate 6 is changed from high impedance to "L". As a result, the power LED 19 is turned on. Next, the 4 bit counter 50 counts input clock CLK and when the count value becomes "FH", Co level is changed from "L" to "H", the output level of the inverter 90 becomes "L", and the output level of the open collector AND gate 6 is changed from "L" to "high impedance". Then, the power LED is turned off.

When the user uses the on-line key 11 and font key 12, operation sequences similar to the above-mentioned sequence are carried out. As a result, an on-line LED is turned on for a predetermined time period when the printer state is changed from an off-line state to an on-line state, and a font LED is turned on for a predetermined time period when the font is changed from A to B.

Further, when the user wants to confirm the state of the printer, by turning on the check key 23, the input level of the inverter 26 becomes "L" for as long as the check key 23 is activated. Then, the output level of OR gate 25 forcibly becomes "H", and an LED corresponding to each operation mode is turned on.

Thus, in accordance with this embodiment, when the user turns on a key to set up the desired operation, or even after the LED corresponding to each operation is turned off, when the user turns on the check key, the LED corresponding to each operation mode can be turned on, thereby reducing the electric power consumed by the LED without affecting the ease with which the user can visually confirm the LEDs.

Further, in this embodiment, by providing a switch means that sets up an input level of the inverter 26 to "L" while the AC power supply is connected to the printer, the LED corresponding to each operation mode can be turned on continuously while the key corresponding to each operation mode is turned on. Accordingly, the user can continuously confirm the LEDs visually.

The fourth embodiment of this invention will now be described in detail with reference to FIG. 4.

Figure 4:
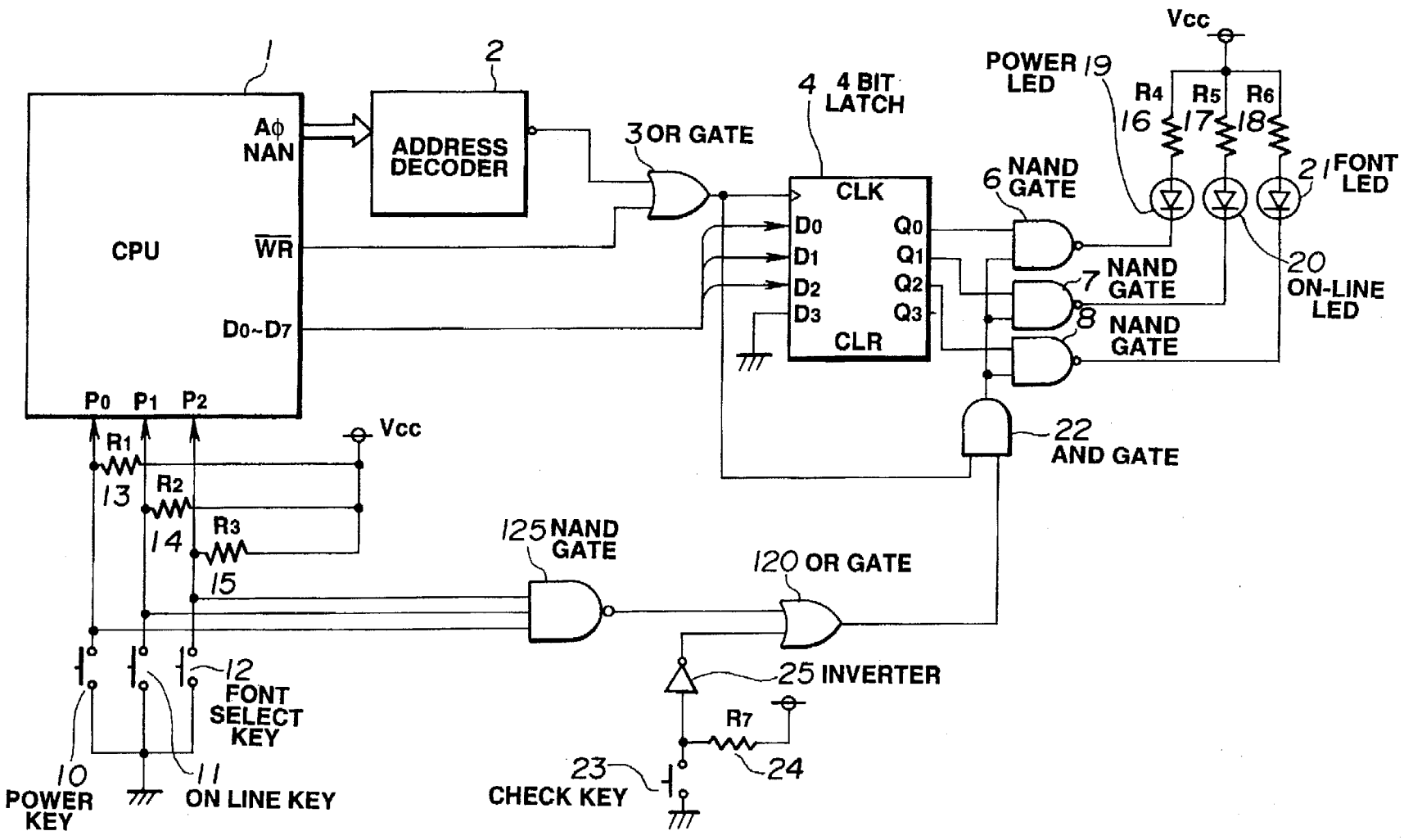
FIG. 4 is a block diagram showing the construction of a printer of a fourth embodiment of the present invention.

FIG. 4 is a block diagram showing a circuit of the apparatus designed in accordance with the fourth embodiment of this invention as applied to a printer.

In the drawing, those components common to the above-mentioned embodiments are referred to by the same reference numerals.

In FIG. 4, reference numeral 1 indicates a CPU, reference numeral 2 indicates an address decoder ("00FFH" corresponds to an output level "L"), reference numeral 3 indicates an OR gate, reference numeral 4 indicates a 4 bit data latch, reference numeral 125 indicates a NAND gate having three inputs ports, reference numerals 6, 7 and 8 each indicate a NAND gate, reference numeral 10 indicates a power key, reference numeral 11 indicates an on-line key, reference numeral 12 indicates a font select key, reference numeral 120 indicates an OR gate, reference numerals 13, 14, 15 and 28 collectively indicate a pull-up resistance, reference numerals 16, 17 and 18 collectively indicate a current restriction resistance for LED, reference numeral 19 indicates a power LED and is turned on when the electric power is supplied to the printer, reference numeral 20 indicates an on-line LED and is turned on when the printer is in an on-line state, reference numeral 21 indicates a font LED and is turned off when the A font is selected and is turned on when the B font is selected, reference numeral 22 indicates an AND gate, reference numeral 23 indicates a check key, and reference numeral 25 indicates an inverter.

Next, an operation of the printer according to the fourth embodiment will be described with reference to FIG. 4.

A power-on operation carried out while the printer is in the power-off state, an on-line state and font A selected state (all LEDs are turned off) will be described.

When the user turns on the power key 10 under the above-mentioned state, an input port Po level is changed from H to L. The CPU 1 detects this change and starts to perform a power-on operation of the printer by outputting address "00FFH" to the address decoder 2 and outputting data "xxxxx001" from outlet ports $D_0$~$D_7$ to the 4 bit latch 4. At that time, CPU 1 outputs a clock signal from outlet port WR to the OR gate 3, and the clock signal from the outlet port WR is supplied to the 4 bit latch 4 through the OR gate 3, because output of the address decoder 2 becomes "L". The data output from the output ports $D_0$~$D_7$ is latched by the 4 bit latch 4 in accordance with the clock signal sent through the OR gate 3. Then, a level of the output $Q_0$ of the 4 bit latch 4 becomes "H", an output level of the AND gate 22 becomes "H" while the user is activating the power key 10, and the output level of the open collector NAND gate 6 becomes "L". As a result, the power LED 19 is turned on.

Next, when the user stops actuating the power key 10, the power key 10 is turned off and output level of the AND gate 22 becomes "L", and the output level of the open collector NAND gate 6 becomes of high impedance condition (H). As a result, the power LED 19 is turned off.

When using the on-line key 11 or the font select key 12, operation sequences similar to the above-mentioned sequence is carried out. Accordingly, when the operation mode is changed from an off-line mode to an on-line mode by using the on-line key 11, the on-line LED is turned on while the user is activating the on-line key 11, and when the font is changed from the A font to the B font by using the font select key 12, the font LED is turned on while the user is activating the font select key 12.

Further, when the user wants to know the state of the printer, by turning on the check key 23, an output level of the inverter 25 becomes "H", and an output level of the OR gate 120 forcibly becomes "H". As a result, the LED corresponding to each operation turns on.

Thus, in accordance with this embodiment, the power consumed by the LED can be reduced without affecting the ease with which the user can visually confirm the LEDs.

Next, the fifth embodiment of this invention will now be described in detail with reference to FIG. 5.

Figure 5:
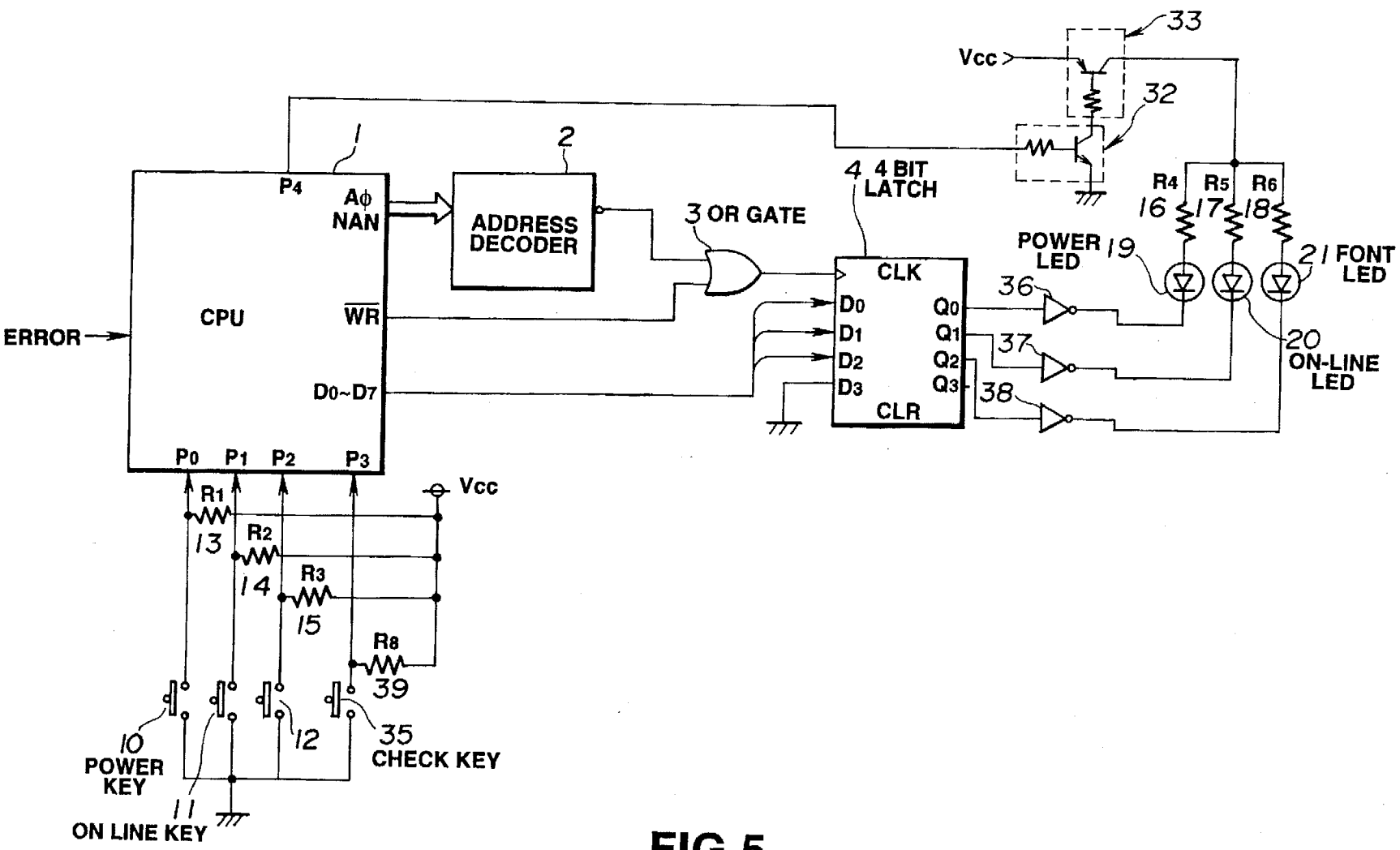
FIG. 5 is a block diagram showing the construction of a printer of a fifth embodiment of the present invention.

FIG. 5 is a block diagram showing a circuit of the apparatus designed in accordance with the fifth embodiment of this invention as applied to a printer.

In the drawing, those components common to the above-mentioned embodiments are referred to by the same reference numerals.

In FIG. 5, reference numeral 1 indicates a CPU which controls the printer, reference numeral 2 indicates an address decoder ("00FF" corresponds to an output level "L"), reference numeral 3 indicates an OR gate, reference numeral 4 indicates a 4 bit data latch, reference numeral 35 indicates a check key which is used by the user to turn ON/OFF an indicator at will, reference numerals 36, 37 and 38 indicate open collector output inverters, reference numerals 13, 14, 15 and 39 collectively indicate a pull-up resistance, reference numeral 10 indicates a power key, reference numeral 11 indicates an on-line key, reference numeral 12 indicates a font select key, reference numerals 16, 17 and 18 collectively indicate a current restriction resistance, reference numerals 32 and 33 each indicate a transistor organizing a complementary constitution.

An operation of the printer according to the fifth embodiment will be described hereinafter with reference to FIG. 5.

After the user turns on the power key while the check key 35 is turned off, when the user turns on the on-line key, the on-line LED is turned on and is afterward turned off. Then, when the user turns on the check key to check the present mode, each LED is turned on again.

The above-mentioned outline will be described in detail. When the user turns on the power key 10, which operates as a set-up means to set up the printer to a predetermined state, the CPU 1 starts to perform a power-on operation and sets a level of P4 to "H" to turn on transistors 32 and 33 and outputs address "00FFH" to the address decoder 2 and outputs data "xxxxx00" from outlet ports $D_0$~$D_7$ to the 4 bit latch 4. At that time, CPU 1 outputs a clock signal from outlet port WR to the OR gate 3. The clock signal from the outlet port WR is supplied to the 4 bit latch 4 through the OR gate 3, because output of the address decoder 2 becomes "L". The data output from the output ports $D_0$~$D_7$ is latched the 4 bit latch 4 in accordance with the clock signal sent through the OR gate 3, whereby the latch 4 sets the output $Q_0$ to be "H" so as to turn on the LED 19. When the power LED 19 is turned on, the CPU 1 starts an internal timer and when the internal timer counts up to a predetermined value, an internal interrupt is generated in the CPU 1, and CPU 1 judges that a predetermined time period has passed, and changes a level of P4 to "L" to turn off transistors 32 and 33, and the power LED 19 is turned off.

Next, when the user turns on an on-line key 11, the CPU 1 starts to perform an on-line operation, and at the same time, the CPU 1 sets a level of P4 to "H" to turn on transistors 32 and 33 and outputs address "00FFH" to the address decoder 2 and outputs data "xxxxx011" from outlet ports $D_0$~$D_7$ to the 4 bit latch 4. At that time, CPU 1 outputs a clock signal from outlet port WE to the OR gate 3. The clock signal from the outlet port WR is supplied to the 4 bit latch 4 through the OR gate 3, because output of the address decoder 2 is "L". The data output from the output ports $D_0$~$D_7$ is latched by the 4 bit latch 4 in accordance with the clock signal sent through the OR gate 3, whereby the latch 4 sets the output $Q_0$ and $Q_1$ to be "H" so as to turn on the LEDs 19 and 20. Then, the power LED 19 and the on-line LED 20 are turned on and the CPU 1 starts an internal timer. Afterwards, when the timer counts up the predetermined value, an internal interrupt is generated in the CPU 1 and the CPU 1 judges that a predetermined time period has passed after the LEDs have turned on, and the CPU 1 changes a level of P4 to "L" to turn off transistors 32 and 33. Then, the power LED 19 and the on-line LED 20 are turned off.

When the user turns on the check key 35 to confirm the present mode of the printer, the CPU 1 changes a level of P4 to "H" to turn on transistors 32 and 33 during the period that the check key 35 is turned on, and the power LED 19 and the on-line LED 20 are turned on due to an output ("0011") of the 4 bit latch. Afterwards, when the user turns off the check key 35, the CPU 1 changes a level of P4 to "L" to turn off transistors 32 and 33. Then, the power LED 19 and the on-line LED 20 are turned off.

If an error occurs in the printer for some reason, the CPU 1 changes a level of P4 to "H" and writes data "xxxxx001" and "xxxxx000" in an address "00FFH" alternately. Then the power LED is repeatedly turned on and off. That is, when there occurs no error in the printer, at first, an LED corresponding to each operation mode is turned on, and after the predetermined time period has passed, all LEDs are turned off. However, when an error occurs in the printer, the power LED is flashed on and off, whereby, compared with that a usual error LED, which is continuously turned on, visual recognition of an error can be improved.

Next, other features of the fifth embodiment will be described.

In recent years, a printer is often connected to LAN (local area network) such as APPLE TALK (trademark) or NETWARE (trademark), and printing is often carried out under the condition that the printer is connected to LAN. Printing is carried out using a printer placed near the host, e.g., a personal computer or a work station. Moreover, printing is often carried out using a printer placed in the LAN area which is apart from the host by 10~16 feet, for example.

In the latter situation, when an error occurs in the printer, for example, a paper for printing is exhausted, since the printer is placed apart from the host by 10~16 feet and indication letters identifying each LED on a panel of the printer are difficult to read, so it is difficult to discriminate which LED is lit, and difficult to confirm whether the LED is turned on due to an occurrence of some error or is turned on merely to indicate an operation mode.

According to the fifth embodiment, however, this problem can be solved. The reason will be described in the actual printing procedure. When the user uses the printer placed apart from the host by 10~16 feet, the user turns on a power switch on the spot, whereby the user can confirm the operation mode, etc. on the spot. After the user confirms that the printer is in good order, the user operates the printer from the place where the host is placed, which is apart from the printer by 10~16 feet If the LED is turned off after the predetermined time period has passed, the user can readily realize that the printer is in a normal condition and is awaiting orders normally.

Then, if no trouble occurs while the user is operating the printer by means of the LAN from the host, the LEDs are not turned on and off, but rather maintain the turned-off state, and the user can realize that the printer is in a normal condition. The user, therefore, confidently completes the printing operation.

On the other hand, when some trouble occurs in the printer, for example, a paper for printing is exhausted, any LED is turned on and off, whereby the user can be alerted of the occurrence of the trouble quickly, even if the user is in the area where the host is placed apart from the printer by 10~16 feet.

Thus, in accordance with the fifth embodiment, a printer, having not only a battery power saving effect but also high efficiency to visually inform the user of an error, can be provided.

The individual components shown in outline or designated by blocks in the drawings are all well-known in the electronics and image recording arts and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An apparatus comprising:

an indicator having a function of indicating a predetermined state of another function of said apparatus;

electric power supply means for supplying electric power to said indicator from a battery;

set-up means for setting up said apparatus in the predetermined state;

selection means for selecting either of a first state in which said indicator can operate and a second state in which said indicator cannot operate;

control means for controlling said electric power supply means so that electric power is supplied to said indicator when the predetermined state of said apparatus is set up by said set-up means, in a case where the first state is selected by said selection means, and for controlling said electric power supply means so that the electric power is not supplied to said indicator, even if the predetermined state of said apparatus is set up by said set-up means, in a case where the second state is selected by said selection means; and detecting means for detecting that an AC power supply is connected to said apparatus, and said control means controls said electric power supply means so that electric power is supplied to said indicator from the AC power supply while said detecting means detects that the AC power supply has been connected to said apparatus, even if the second state is selected by said selection means.

2. An apparatus according to claim 1, further comprising a confirmation switch for confirming the predetermined state of said apparatus, wherein said control means controls said electric power supply means so that electric power is supplied to said indicator when said confirmation switch is actuated.

3. An apparatus according to claim 1, wherein said control means controls said electric power supply means to prevent supply of the electric power to said indicator, in a case where the second state is selected by said selection means, when the predetermined state of said apparatus is set up, while maintaining said apparatus in the predetermined state.

4. An apparatus according to claim 1, wherein said selection means comprises a switch operable by a user to select either of the first state and the second state by operating said switch.

5. An apparatus according to claim 1, wherein said apparatus comprises a printer.

6. An apparatus according to claim 1, wherein said indicator indicates an on-line or off-line state of said apparatus.

7. An apparatus according to claim 1, wherein said indicator indicates a power-on or power-off state of said apparatus.

8. An apparatus according to claim 1, wherein said indicator indicates a state of a font of said apparatus.

9. A printing apparatus for communicating with a host device, said printing apparatus comprising:

printing means for printing information supplied from the host device on a printing medium;

an indicator having a function of indicating a predetermined state of another function of said apparatus;

electric power supply means for supplying electric power to said indicator from a battery;

set-up means for setting up said apparatus in the predetermined state;

selection means for selecting either of a first state in which said indicator can operate and a second state in which said indicator cannot operate;

control means for controlling said electric power supply means so that electric power is supplied to said indicator when the predetermined state of said apparatus is set up by said set-up means, in a case where the first state is selected by said selection means, and for controlling said electric power supply means so that the electric power is not supplied to said indicator, even if the predetermined state of said apparatus is set up by said set-up means, in a case where the second state is selected by said selection means; and detecting means for detecting that an AC power supply is connected to said apparatus, and said control means controls said electric power supply means so that electric power is supplied to said indicator from the AC power supply while said detecting means detects that the AC power supply has been connected to said apparatus, even if the second state is selected by said selection means.

10. A printing apparatus according to claim 9, further comprising a confirmation switch for confirming the predetermined state of said apparatus, wherein said control means controls said electric power supply means so that electric power is supplied to said indicator when said confirmation switch is actuated.

11. A printing apparatus according to claim 9, wherein said control means controls said electric power supply means to prevent supply of the electric power to said indicator, in a case where the second state is selected by said selection means, when the predetermined state of said apparatus is set up, while maintaining said apparatus in the predetermined state.

12. A printing apparatus according to claim 9, wherein said selection means comprises a switch operable by a user to select either of the first state and the second state by operating said switch.

13. A printing apparatus according to claim 9, wherein said set-up means sets up the predetermined state of power supply to said apparatus and said indicator indicates that power is being supplied to said apparatus.

14. A printing apparatus according to claim 9, wherein said set-up means sets up the predetermined state of said apparatus being on-line with the host device and said indicator indicates that said apparatus is on-line with the host device.

15. A printing apparatus according to claim 9, wherein said set-up means sets up the predetermined state of the printing means printing with a predetermined font style and said indicator indicates that said printing means is set up to print with the predetermined font style.

16. An apparatus according to claim 9, wherein said indicator indicates an on-line or off-line state of said apparatus.

17. An apparatus according to claim 9, wherein said indicator indicates a power-on or power-off state of said apparatus.

18. An apparatus according to claim 9, wherein said indicator indicates a state of a font of said apparatus.

19. An apparatus comprising:

an indicator having a function of indicating a predetermined state of another function of said apparatus;

key-input means for setting up said apparatus in the predetermined state; and electric power supply means for supplying electric power to said indicator from a battery during a time period corresponding to an operation time of said key-input means by a user and for stopping supply of the electric power to said indicator after supplying the electric power to said indicator from the battery during the time period, wherein said apparatus is maintained in the predetermined state set up by said key-input means even after stopping supply of the electric power to said indicator.

20. An apparatus according to claim 19, further comprising input means for confirming whether said apparatus is set up in the predetermined state, and means for supplying the electric power to said indicator from the battery in response to an input signal from said input means when said apparatus is set up in the predetermined state.

21. An apparatus according to claim 20, wherein said input means comprises a second key-input means operable by a user.

22. An apparatus according to any one of claims 19–21, wherein said apparatus effects recording in accordance with image data transmitted from a host apparatus.

23. An apparatus according to claim 19, wherein said indicator indicates an on-line or off-line state of said apparatus.

24. An apparatus according to claim 19, wherein said indicator indicates a power-on or power-off state of said apparatus.

25. An apparatus according to claim 19, wherein said indicator indicates a state of a font of said apparatus.

26. An apparatus comprising:

an indicator having a function of indicating a predetermined state of another function of said apparatus;

electric power supply means for supplying electric power to said indicator from a battery;

set-up means for setting up said apparatus in the predetermined state;

stop means for stopping supply of the electric power to said indicator, while maintaining said apparatus in the predetermined state; and input means for generating an input signal for confirming whether said apparatus is set up in the predetermined state, said input means comprising means for supplying electric power to said indicator from the battery during a time period when the input signal is being generated in a state where supply of the electric power to said indicator is stopped by said stop means.

27. An apparatus according to claim 26, wherein said stop means comprises key-input means, operable by a user, for causing stopping of supply of the electric power to said indicator in accordance with an operation of said key-input means.

28. An apparatus according to claim 26, wherein said stop means comprises timing means for timing a predetermined time period in accordance with supply of the electric power to said indicator, said timing means stopping supply of the electric power to said indicator after the predetermined time period.

29. An apparatus according to claim 26, wherein said input means comprises key-input means operable by a user.

30. An apparatus according to any one of claims 26–29, wherein said apparatus effects recording in accordance with image data transmitted from a host apparatus.

31. An apparatus according to claim 26, wherein said indicator indicates an on-line or off-line state of said apparatus.

32. An apparatus according to claim 26, wherein said indicator indicates a power-on or power-off state of said apparatus.

33. An apparatus according to claim 26, wherein said indicator indicates a state of a font of said apparatus.

* * * * *